United States Patent [19]

Pawl

[11] 4,003,172

[45] Jan. 18, 1977

[54] PERIPHERALLY GROOVED BUILDING BLOCKS IN A WALL CONSTRUCTION

[76] Inventor: Walter S. Pawl, 2844 Powder Mill Road, Adelphia, Md. 20783

[22] Filed: Sept. 30, 1975

[21] Appl. No.: 618,024

[52] U.S. Cl. ..... 52/279; 52/286; 52/437; 52/605; 52/591; 52/610

[51] Int. Cl.[2] ..... E04B 2/72; E04C 1/10; E04C 2/46

[58] Field of Search ..... 52/284, 286, 606, 444, 52/437, 396, 605, 279, 744, 591, 610

[56] References Cited

UNITED STATES PATENTS

| | | | |
|---|---|---|---|
| 293,800 | 2/1884 | Simonds | 52/605 |
| 990,119 | 4/1911 | Diamond | 52/606 |
| 1,383,166 | 6/1921 | Steinkraus | 52/396 |
| 1,448,648 | 3/1923 | Wilkins | 52/591 |
| 3,427,774 | 2/1969 | Curtis | 52/605 |
| 3,562,988 | 2/1971 | Gregoire | 52/279 |

*Primary Examiner*—Price C. Faw, Jr.
*Assistant Examiner*—James L. Ridgill, Jr.

[57] ABSTRACT

The interlocked building blocks, which normally require no mortar, have undercut grooves around their face edges, forming dove-tail-sectioned grooves at all the joints between adjacent blocks in a wall, which may be used to receive and hold sealing material for the joints, as well as to provide suitable support means for fixing attachment hooks or clips to the wall.

4 Claims, 19 Drawing Figures

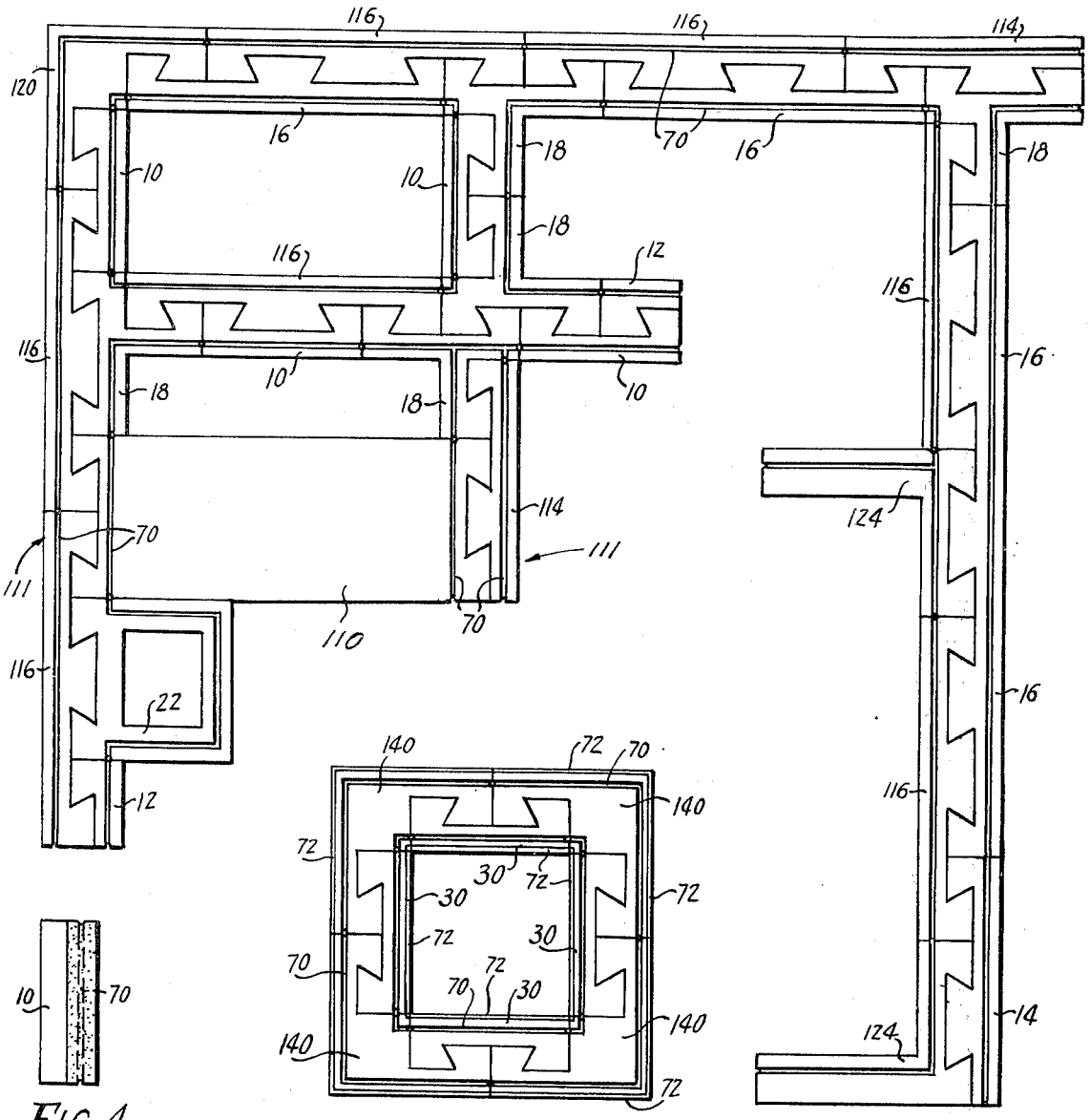
FIG. 1
FIG. 2
FIG. 4
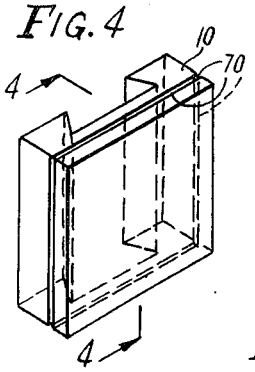
FIG. 3
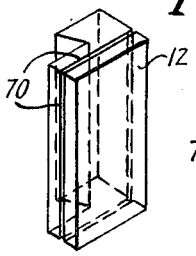
FIG. 5
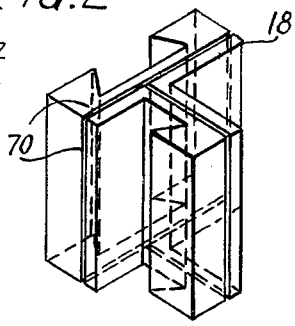
FIG. 6
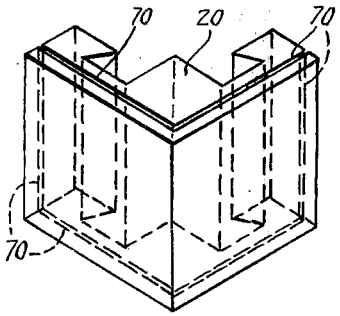
FIG. 7

PERIPHERALLY GROOVED BUILDING BLOCKS IN A WALL CONSTRUCTION

In walls of the mortarless type of blocks such as disclosed in U.S. Pats. Nos. 3,562,988 and 3,562,989, where sealing was Desired, it was found difficult to use gaskets or interface strips, especially between the load-bearing surfaces of the blocks, because of interference with the close tolerances required to keep the running fit surfaces in alignment for easy laying of successive rows of blocks in the assembly of a wall.

On the other hand, to apply mortar or other sealing material to the joints after the wall was assembled would be awkward without grooving out the joints, and would also make it difficult to dissemble the wall without spoiling the blocks for reuse in another mortarless assembly. However, it was discovered that by pregrooving the face edges of the blocks, continuous composite grooves would be provided at all the joints in a wall for easy insertion of non-adhesive resilient strips or packing, to provide sealing when desired, without spoiling the blocks for reuse.

It is therefore an object of this invention to provide sealing means for these block joints without spoiling the blocks for reuse or impairing their alignment for easy assembly and disassembly.

A further object is to make a building block having a undercut peripheral groove around the edges of its face, to provide a composite groove at the joints between adjacent blocks in a wall for receiving and holding any impervious material therein to seal the joints.

A further object is to make a building block with a peripheral groove around the sides of the block and spaced back from the face thereof, to provide a composite channel at the joints between adjacent blocks in a wall, for receiving and holding impervious material therein to seal the joints.

Figure 8:
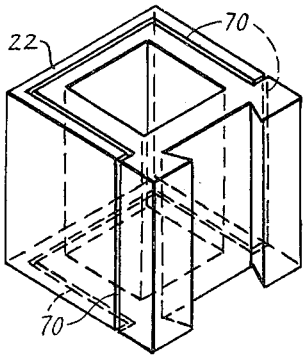
Figure 9:
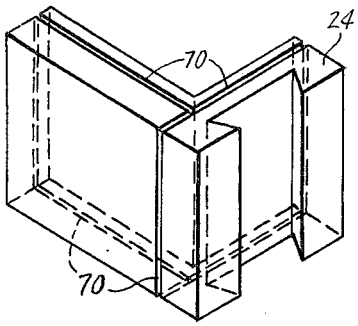
Figure 10:
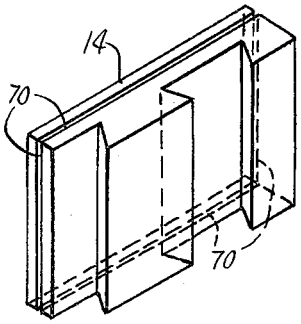
Figure 14:
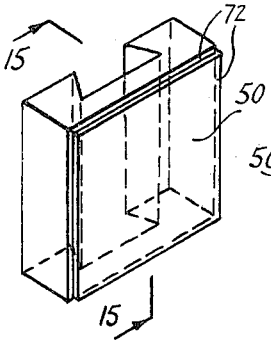
Figure 15:
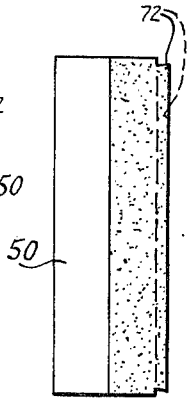
Figure 11:
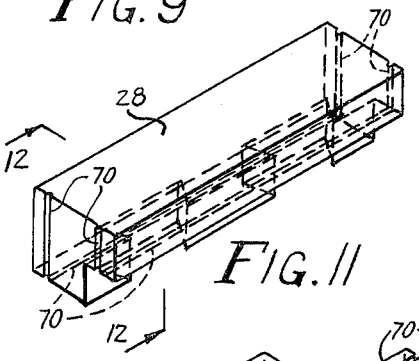
Figure 12:
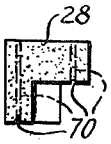
Figure 13:
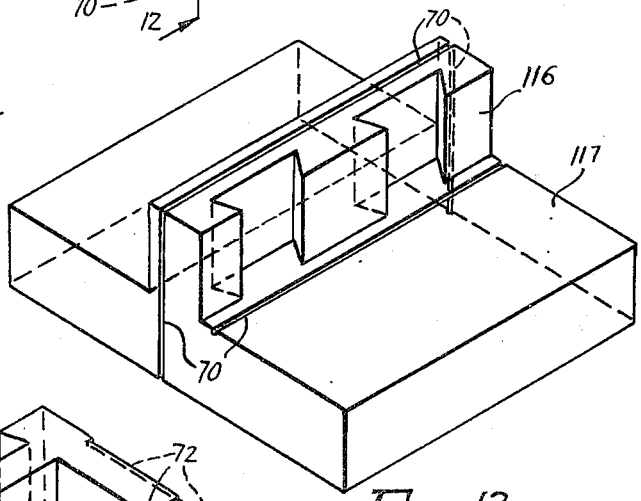
Figure 16:
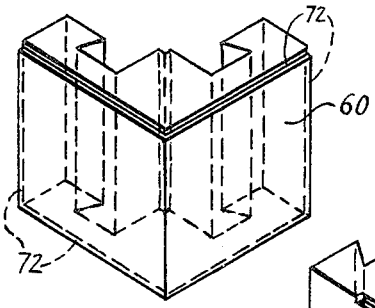
Figure 18:
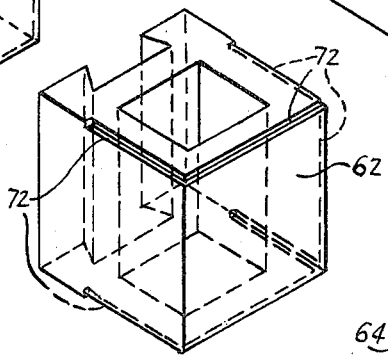
Figure 17:
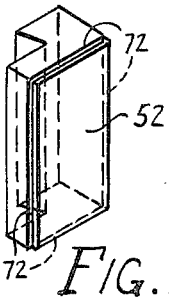
Figure 19:
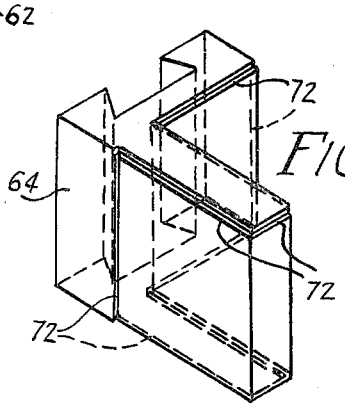

Other and more specific objects will become apparent in the following description of the invention, as illustrated in the accompanying drawings, wherein:

FIG. 1 is a plan view of a wall structure using interlocking blocks of the motarless type and having peripheral grooves spaced back from their exposed faces, in accordance with the present invention, FIG. 2 is a plan view of an enclosed wall structure of blocks having additional peripheral grooves right in the corner edges of their exposed faces, FIG. 3 is a perspective view of a unit block for a linear wall, with a peripheral groove, spaced from its face, FIG. 4 is a vertical sectional view of this block, taken on the line 4—4 in FIG. 3, FIG. 5 is a perspective view of a half length block having this concealed type of groove, FIG. 6 is a perspective view of a T-block with this concealed type of groove, FIG. 7 is a perspective view of a corner block with this type of concealed type of groove, FIG. 8 is a perspective view of a chimney block having this type of concealed groove, FIG. 9 is a perspective view of a block having a vertical slab projecting from its face, with this concealed type of groove, FIG. 10 is a perspective view of a one and a half length block with this concealed type of groove, FIG. 11 is a perspective view of a double length cap block with a half height interlocking block portion suspended therefrom and having this type of concealed groove, FIG. 12 is a vertical sectional view of this cap block taken on the line 12—12 in FIG. 11, FIG. 13 is a perspective view of a double length base block with this concealed type of groove, FIG. 14 is a perspective view of a unit block provided with a peripheral groove in the corner edges of its face, FIG. 15 is a vertical sectional view of this block taken on the line 15—15 in FIG. 14, FIG. 16 is a perspective view of a corner block with a corner edge type of groove around its two faces, FIG. 17 is a perspective view of a half length block with the corner edge type of groove, FIG. 18 is a perspective view of a chimney block with the corner type of groove, and FIG. 19 is a perspective view of a projecting vertical slab block having this corner edge type of peripheral groove.

Referring now to the drawings in detail, FIG. 1 illustrates an assembly of interlocking block in a wall structure, wherein the blocks are provided with the concealed type of grooves. The unit blocks are indicated by the numeral 10, the half length blocks, 12, the one and a half length blocks, 14, the double length blocks, 16, the T-blocks, 18, the corner blocks, 20, the chimney blocks, 22, the half height double length blocks with the base slab 117, the double length cap block, 28, and the beam 110 with its end faces formed like the interlocking inner faces of the blocks which they replace at their points of support in the respective wall segments 111.

In assembling a wall, a row of half height block units is laid on corresponding base slabs, such as 117, or they may be made integral with the base base slabs, which are lined up for the base of the wall. In FIG. 1 the half height blocks are indicated by numerals higher by 100 than those indicating their full height counterparts, and the corresponding base slabs are indicated by the next higher numbers. The first row of half height 116, 116, 120, 116, 116 and 114, shown around the outside of the left and upper wall portions shown in FIG. 1, form the base of the outer layer of blocks in these wall portions. These are half height blocks. The row of interlocking full height blocks 12, 22, 10, 18, 10, 16, 18, 16 1nd 18 are then layed to form the base of the inner layer of blocks in this wall. Then rows of full height blocks may be layed successively in rows in the alternate layers in overlapping relationship to any height desired. The rest of the wall structure shown is similarly built up.

Before laying each row of blocks, a sealing material of suitable type may be laid in the horizontal groove on top of the previous row and also stuffed into the vertical channels in the end joints between the blocks of said row, and after laying the new row in one layer of the wall, the same process is repeated before laying the successive rows in the opposite layers of the wall as it is built up, in order to provide a complete sealing of all the joints in the wall. The peripheral grooves 70 form continuous channels throughout all the joints, as shown.

When the desired height is reached, cap blocks 28 may be similarly laid to finish the top of a wall.

In FIG. 2, an enclosed wall structure is illustrated, showing half height blocks 140 at the corners in the outer layer row at the base of the wall. These blocks are half height. The base row of the inner layer of the wall is layed to interlock with the outer layer and consists of the full height blocks indicated by numerals 30. Additional rows of full height blocks may then be layed successively in vertically overlapping relation in the opposite layers of the wall to any height, as already explained.

The blocks 30 are identical in form to the unit blocks 10, but are provided not only with the grooves 40 but also the peripheral grovves 72 at the corner edges of the exposed faces of the blocks.

These grooves 72 may be used for receiving and holding sealing material for all the joints in a wall, and may also serve to provide support ledges for hooks or clips to suspend or fix attachments of any kind to the wall, when desired. These corner grooves 72 may be used alone as substitutes for the grooves 70, or the blocks may be made with both types of grooves, as shown.

Some of the block forms having only the exposed type of grooves 72 are individually shown in the drawings, as the unit block 50 in FIGS. 14 and 15, the corner block in FIG. 16, the half length block 52 in FIG. 17, the chimney block in FIG. 18 and the vertical slab projection block 64 in FIG. 19.

The grooves 72 may be undercut as shown in profile in FIG. 15, so that the composite grooves formed along the joints beween adjacent blocks in a wall will have a dove-tail crosssection to facilitate packing and holding of the sealing material securely against the joints in the bottom of the composite dove-tail grooves. The sides of these grooves will also provide vertical and horizontal ledges for hooking or gripping or clipping attachments.

The peripheral grooves 70 or 72 could be formed to receive and hold a peripheral bulging strip of resilient impervious material around each block before the blocks are assembled in a wall, so that the opposed bulging strips in adjacent blocks would be resiliently held together to form a continuous seal in all the joints without spreading into the load-bearing or sliding surface joints between the adjacent blocks.

Many other obvious modifications in the form and structure of these grooved blocks may be made without departing from the spirit and scope of this invention.

What is claimed is:

1. A wall construction of concrete blocks assembled without a binder therebetween and comprising a plurality of linear wall segments each comprising a double layer of blocks with the blocks in one layer overlapping the blocks in the other layer both horizontally and vertically, said blocks having identical horizontal sections with the inner faces of blocks in one layer having alternate and equal vertically co-extensive dove-tail grooves and ridges slidably interlocked with similar vertical coextensive dove-tail grooves and ridges in the inner faces of the blocks in the other layer, a corner wall segment comprising corner blocks having a plurality of angularly extending block portions joined to the linear wall segments, the corner block portions each having an identical half groove and half ridge interlocked in a running fit with the inner faces of end blocks of the linear wall segments, two spaced linear wall segments having a beam supported between them at points normally provided for a block in each of said wall segments, said beam having end faces formed like the interlocking inner faces of the blocks which they replace at their points of support in the respective wall segments, the dove-tail grooves and ridges on said blocks having planar faces which are positioned in face-to-face relationship when interlocked to define a close yet free fit without any noticeable play between interlocked blocks so that the wall is assembled without a binding agent between blocks, each block and beam end in said wall construction having a peripheral undercut groove extending completely around its face edges, the edge grooves of adjacent blocks forming undercut double groove channels along the joints, holding non-adhesive resilient packing strips for sealing without binding said joints and providing some frictional sliding movement between load-bearing surfaces of the blocks limited by the lateral clearances between their interlocking faces.

2. A wall construction as defined in claim 1, said grooves forming composite undercut grooves along all the joints between adjacent blocks in said wall.

3. A wall as defined in claim 2, said peripheral grooves being undercut in the corner edges of said exposed faces forming dove-tail composite grooves along the joint.

4. A wall as defined in claim 2, said peripheral grooves being spaced back of the corner edges to form concealed composite channels in said joints.

* * * * *